US005389473A

United States Patent [19]

Sokolov

[11] Patent Number: 5,389,473

[45] Date of Patent: Feb. 14, 1995

[54] METHOD OF PRODUCING X-RAY GRIDS

[76] Inventor: Oleg Sokolov, 1-27 Beverbrook Rd., Danbury, Conn. 06810

[21] Appl. No.: 149,767

[22] Filed: Nov. 10, 1993

[51] Int. Cl.[6] ..... G21K 1/02

[52] U.S. Cl. ..... 430/4; 430/321; 430/966; 430/967; 374/154; 156/654

[58] Field of Search ..... 430/5, 321, 966, 967, 430/4; 378/149, 154; 156/643, 654, 663

[56] References Cited

U.S. PATENT DOCUMENTS

| | | | |
|---|---|---|---|
| 1,476,048 | 12/1923 | Bucky | 378/154 |
| 5,102,776 | 4/1992 | Hammer et al. | 430/311 |
| 5,231,654 | 7/1993 | Kwasnick et al. | 378/147 |
| 5,231,655 | 7/1993 | Wei et al. | 378/147 |

FOREIGN PATENT DOCUMENTS 441019 11/1974 U.S.S.R. .

OTHER PUBLICATIONS

"Silver Halide-Chalcogenide Glass Inorganic Resists for X-Ray Lithography", Kolwicz et al., J. Electrochem. Soc. (Jan. 1980) vol. 127, No. 1.

*Primary Examiner*—Charles L. Bowers, Jr.
*Assistant Examiner*—John A. McPherson

[57] ABSTRACT

An X-ray grid is produced by exposing of a photosensitive glass with a differential of solubility not less than 25 and with a radiation having a wavelength shorter than a wavelength of ultraviolet radiation.

6 Claims, No Drawings

METHOD OF PRODUCING X-RAY GRIDS

BACKGROUND OF THE INVENTION

The present invention relates to methods of producing X-ray grids.

It is known to produce X-ray grids by mechanically glueing alternating X-ray transmitting and X-ray non transmitting layers. However, the mechanical process of their manufacture is difficult. Also, an X-ray grid is known which is composed of a monolithic panel with openings and a coating which is composed of an X-ray absorbing material. The monolithic panel is composed of a light sensitive glass and is exposed by a light beam passing through a mask which corresponds to a pattern of the X-ray grid. This method has certain limitations with respect to thickness of the panel and a relatively low accuracy of the finished grid due to distortions of the light beam at the edges of the mask and openings.

Finally, in accordance with another method an X-ray grid is produced from a light-sensitive glass which is exposed through a thin shaping device or mask so that various areas of the panel are exposed with different intensities, and then the image produced by the exposure is developed by heating, and the panel is etched in an aqueous solution of hydrofluoric acid, so that a grate is produced by forming of openings which are made in the exposed areas and separated by partitions in non-exposed areas. The thusly produced panels are glued together as layers so that the axes of the openings coincide with each other, and a grid of the desired thickness is produced. The glass can be an X-ray absorbing glass, or its inner walls of the openings can be covered with an X-ray absorbing coating.

In this method in order to produce a finished X-ray grid, several thin dispersing grates are assembled to form a grid, and each layer must have openings aligned with the openings of the neighboring layers. This method requires assembling of the layers so that a great numbers of openings can be aligned with each other and directed to a common focal point of the grid. For example, with the optimal number of strips 30 per cm, the number of openings in the cellular grid per 1 $cm^2$ is 900; and with the efficient area of the grid 340×420 mm the number of openings in each layer of the grid is 1 398 600. It is evident that it is difficult to manufacture such panels having such great number of openings with high accuracy with exact coincidence of the openings and the partitions, or actually practically impossible. Utilization of electromagnetic radiation with a relatively great wavelength which is commensurate with the wavelength of the ultraviolet region of the spectrum leads to distortions of the formed image through the thickness of the exposed panel due to refraction, reflection and dispersion in the exposed glass of the rays which form the image, and the absolute value of the distortion increases with the increase of the thickness of the exposed panel. When the flat shaping device is utilized, substantial distortion of the formed images of elements of an X-ray grid does not permit obtaining of a non-distorted three-dimensional image of the grid in the panels of the substantial thickness, for example when it is necessary to provide the grid ratio of 6, 8, 12, etc. This is why it was necessary to make a composite grid. This method also cannot be used for making parallel X-ray grids, since it involves the use of only a pointed radiation source.

SUMMARY OF THE INVENTION

Accordingly, it is an object of the present invention to provide a new method of producing X-ray grids, which is more efficient and increases grid quality since it makes possible producing the openings of the grid in a monolithic panel of a required thickness.

In keeping with these objects and with others which will become apparent hereinafter, one feature of the present invention resides, briefly stated, in a method of producing an X-ray grid, in accordance with which a panel or plate of a photosensitive material is exposed through a mask and then developed to produce a hidden image and etched, wherein in accordance with the new features of the present invention the photosensitive material is a photosensitive glass with a differential of solubility not less than 25, and the-exposure is performed with a radiation having a wavelength which is shorter than a wavelength of an ultraviolet radiation, for example by X-ray radiation or gamma radiation.

When the method is performed in accordance with the present invention, X-ray grids can be produced with much higher output and much higher quality than in accordance with previously known methods.

The novel features of the present invention will be best understood from the following description of preferred embodiments.

DESCRIPTION OF PREFERRED EMBODIMENTS

In accordance with the method of the present invention a monolithic panel is first produced from a photosensitive glass which has a differential of solubility not less than 25 and has side sizes and a thickness which corresponds to required sizes and ratio of the grid. For example, the glass can have the following content (mass %):

$SiO_2$ 78–82; $Al_2O_3$ 3.2–4.8; $Li_2CO_3$ 11–14; $Ca_2CO_3$ 1.5–3.5; $CeO_2$ 0.20–0.40; $SnO_2$ 0.15–0.45; AgCl 0.01–0.035.

The panel is then exposed by radiation beams for producing a hidden image of an X-ray to be produced, through the whole thickness of the panel. In order to ensure passage of the specifically shaped beams of radiation through the whole thickness of the monolithic panel without distortion of the formed image (in other words without refraction, reflection and dispersion of the rays) and also in order to prevent formation of semi-shadows at the borders of the image, the exposure is performed by a short wave electromagnetic radiation with a wavelength which is shorter than a wavelength of an ultraviolet radiation, for example, with X-ray radiation having a wavelength 0.6–0.03 A or gamma radiation having a wavelength 0.02–0.01 A.

In order to provide the beams of the exposing radiation, which forms the three-dimensional grid image, with a desired three dimensional shape and also in order to prevent falling onto the panel of rays which extend not in the direction of shaping of the image, a volumetric tunnel-shaped mask-like device is utilized, such as for example the device disclosed in my patent application Ser. No. 08/009,976 filed on Jan. 27, 1993, now U.S. Pat. No. 5,307,394. The device is designed so that only those beams can pass through it and fall onto parts of the panel which have a shape and an angle providing the formation of a hidden image of openings (cells or lines), but the beams do not fall on the parts of the panel which must contain the image of partitions between the openings, and also semi-shadows at the borders of the images are not formed. This device can use a radiation source of any size and shape, and it can be located not in a focal point of the grid.

After the exposure the panel is subjected to a thermal treatment to a temperature between 450°–700° C., for example 600° C., in order to develop the hidden image of the grid. Then the panel is etched in a 10–20%, for example 15%, aqueous solution of hydrofluoric acid. Thereby a grid is produced in which directional throughgoing openings are located at the exposed parts of the panel and partitions between the openings are formed at the non-exposed parts of the panel.

During the time corresponding to the etching of the opening (exposed part of the glass) over the length 2h (since the etching is performed from two sides simultaneously), the partition (non-irradiated part) is etched in direction of increase of the width of the opening d by the value 2Δd (since the etching is performed in direction of increase of the diameter in two directions in the longitudinal section simultaneously. The differential of solubility is a ratio of speeds of etching of exposed and not exposed parts, as follows:

$$a = \frac{2h}{2\Delta d},$$

wherein a is a differential of solubility, $2h = r \times d$ in the case of a grid, $r \geqq 5$ is a ratio of the grid from requirements of radiology (ratio of $r=5$ of a cellular grid corresponds ro $r=10$ of a linear grid), d is a diameter of the opening;

$$\Delta d = 0.01\delta \times d$$

$\delta \leqq 10\%$ is a maximum permissible relative error of geometrical sizes of the produced opening. Thus the mathematical expression of the differential of solubility for the grid is:

$$a = \frac{r \times d}{2 \times 0.01 \times \delta \times d}.$$

After the calculations $$a \geqq \frac{5}{2 \times 0.01 \times 10}$$

$a \geqq 25$.

Then the openings are covered with a thin coating of an X-ray absorbing material, for example, lead or tungsten so as to provide a uniform coating of high density with a thickness of 0.050–0.040 mm over the whole length and width of the partitions, for example with an electrolythic or carbonilic coating. The coated partitions form strips of the grid, while the openings between the partitions form the cells of the grid, so as to form a monolithic grate of the grid. In order to increase the strength of the grid its sides are formed as a monolithic frame without openings, while its surfaces are provided with covers from an X-ray highly transparent material.

The new methods increases the efficiency of manufacture and the quality of the grids since it makes possible the production of the grids with maximum X-ray transparency for primary radiation and especially for long wave X-ray radiation, with substantially increased absorbency of scattered radiation especially with the cellular grid so as to increase contrast, sharpness and resolution. This in turn improves the quality of X-ray pictures and reduces radiation action on patients and medical personnel.

The present invention is not limited to the details shown since various modifications and structural changes are possible without departing in any way from the spirit of the present invention.

What is desired to be protected by Letters Patent is set forth in the appended claims.

I claim:

1. A method of producing an X-ray grid, comprising the steps of providing a monolithic panel of a photosensitive material;

exposing the panel through a masking device to produce in the panel a hidden image;

developing the hidden image in the panel by a thermal treatment;

etching the photosensitive monolithic panel after said developing so as to form a monolithic grate with a plurality of cells with partitions therebetween; and covering the partitions with an X-ray absorbing material, said providing including using as the photosensitive material a photosensitive glass with a differential of solubility not less than 25, and said exposing including exposing with a radiation having a wavelength which is shorter than a wavelength of an ultraviolet radiation.

2. A method as defined in claim 1, wherein said developing includes heating the panel to a temperature substantially equal to 450°–700° C.

3. A method as defined in claim 1, wherein said exposing includes exposing with X-ray radiation.

4. A method as defined in claim 1, wherein said exposing includes exposing with gamma radiation.

5. A method as defined in claim 1; and further comprising the step of covering opposite transverse sides of the panel with covers composed of an X-ray transmitting material.

6. A method as defined in claim 1, wherein said covering with an X-ray absorbing material includes covering with X-ray absorbing material all surfaces of said monolithic panel including inner surfaces of said cells.

* * * * *